US012502591B2

(12) United States Patent
Taylor

(10) Patent No.: US 12,502,591 B2
(45) Date of Patent: Dec. 23, 2025

(54) GOLF SWING TOOL

(71) Applicant: Thrasio, LLC, Walpole, MA (US)

(72) Inventor: Curtis Taylor, Chagrin Falls, OH (US)

(73) Assignee: Brands to Retail, LLC, Cleveland, OH (US)

( * ) Notice: Subject to any disclaimer, the term of this patent is extended or adjusted under 35 U.S.C. 154(b) by 243 days.

(21) Appl. No.: 18/212,498

(22) Filed: Jun. 21, 2023

(65) Prior Publication Data

US 2024/0058678 A1 Feb. 22, 2024

Related U.S. Application Data

(60) Provisional application No. 63/399,096, filed on Aug. 18, 2022.

(51) Int. Cl.
*A63B 69/36* (2006.01)
*A63B 71/06* (2006.01)

(52) U.S. Cl.
CPC .. *A63B 69/3623* (2013.01); *A63B 2071/0694* (2013.01); *A63B 2209/08* (2013.01); *A63B 2210/50* (2013.01); *A63B 2225/09* (2013.01)

(58) Field of Classification Search
CPC ..... A63B 69/3623; A63B 2071/0694; A63B 2209/08; A63B 2210/50; A63B 2225/09; A63B 2225/093
USPC ..... 473/207, 218, 257, 266, 270, 1, 272
See application file for complete search history.

(56) References Cited

U.S. PATENT DOCUMENTS 1,624,535 A * 4/1927 Christianson ..... E04F 21/26 33/461
4,813,149 A * 3/1989 Herkimer ..... B25H 7/00 D10/69
4,871,175 A * 10/1989 Levin ..... A63B 69/3667 473/218
5,350,177 A * 9/1994 Furbush, Jr. ..... A63B 69/36211 473/409
5,464,220 A * 11/1995 Hansen ..... A63B 69/3667 473/409
7,775,900 B1 * 8/2010 Karpyak ..... A63B 69/3667 473/270
2014/0080619 A1 * 3/2014 Heddleston ..... A63B 69/3667 473/409
2024/0058679 A1 2/2024 Taylor

* cited by examiner

*Primary Examiner* — Nini F Legesse
(74) *Attorney, Agent, or Firm* — Pearl Cohen Zedek Latzer Baratz LLP

(57) ABSTRACT

An apparatus, method, and system for a golf swing tool for improving the swing of a golfer.

23 Claims, 9 Drawing Sheets

GOLF SWING TOOL

The present disclosure claims priority to U.S. Provisional Application Ser. No. 63/399,096 filed Aug. 18, 2022, which is incorporated herein by reference.

FIELD OF THE DISCLOSURE

This disclosure relates to golfing, and specifically to a tool for improving the swing of a golfer.

BACKGROUND

Many different products have been developed to improve the golf swing of a golfer. Such tools include STRYK Easy Path Golf Swing Training Aid™ and the EyeLine Golf Speed Trap 1.0™. Both of these devices have been developed to improve the swing of a golfer. The present disclosure is an improvement of these two golf swing tools.

SUMMARY OF DISCLOSURE

This disclosure relates to a golf tool for improving the swing of a golfer. The golf tool can be configured to be easy to assemble and optionally easily disassembled into a compact form for easy carrying and/or storage.

In one non-limiting aspect of the disclosure, there is provided a golf swing tool that includes a base body that includes three longitudinal panels. The second and third panels are each connected to the first panel and the second and third panels are spaced from one another. The shape of the panels is non-limiting. In one non-limiting embodiment, 60-100% (and all values and ranges therebetween) of the longitudinal length of one or more of all of the panels has a generally rectangular shape. In another non-limiting embodiment, two or all of the panels have a longitudinal length that has a difference in longitudinal length that is within 0-10% (and all values and ranges therebetween) of one another. In another non-limiting embodiment, the first panel is longer than the second and/or third panels. In another non-limiting embodiment, two or all of the panels have the same width or a width that has a difference that is within 0-10% (and all values and ranges therebetween) of one another. In one non-limiting configuration, the second and third panels have a) a longitudinal length that is the same or within 0-5% of one another, b) a width that is constant along at least 70% (e.g., 70-100% and all values and ranges therebetween) of the longitudinal length of each of the panels, c) a thickness that is constant along at least 70% (e.g., 70-100% and all values and ranges therebetween) of the longitudinal length of each of the panels, and/or d) an outer perimeter shape that is same along at least 70% (e.g., 70-100% and all values and ranges therebetween) of the longitudinal length of each of the panels. The material used to form the panels is non-limiting (e.g., plastic, metal, wood, ceramic, glass, composite material, etc.). In one non-limiting embodiment, each of the panels are formed of the same material. In another non-limiting embodiment, the panels are formed of a plastic material.

In another and/or alternative non-limiting aspect of the present disclosure, the second and/or third panel are pivotally connected to the first panel. The type of pivot connection is non-limiting. In one non-limiting embodiment, the second and third panels are connected to the first panel such that the second and/or third panels can rotate at least 30° (e.g., 30-360° and all values and ranges therebetween) about a pivot or connection point between the second panel and the first panel and/or the third panel and the first panel. In one non-limiting configuration, the second and third panels are connected to the first panel such that the second and/or third panels can rotate no more than 270° (e.g., 0-270° and all values and ranges therebetween) about a pivot or connection point between the second panel and the first panel and/or the third panel and the first panel. In another non-limiting configuration, the second and third panels are each connected to the first panel such that the second and third panels can rotate no more than 135° (0-135° and all values and ranges therebetween) about a pivot or connection point between the second panel and the first panel and the third panel and the first panel. In another non-limiting configuration, the second and third panels are each connected to the first panel such that the second and third panels can rotate no more than 100° (0-100° and all values and ranges therebetween; 0-90°, etc.) about a pivot or connection point between the second panel and the first panel and the third panel and the first panel. In another non-limiting configuration, the second and third panels are each connected to the first panel such that the second panel can only rotate clockwise about the pivot or connection point between the second panel and first panel when the second panel is moved to the open position, and the third panel can only rotate counter-clockwise about the pivot or connection point between the third panel and first panel when the third panel is moved to the open position.

In another and/or alternative non-limiting aspect of the present disclosure, the first panel has and adjustable longitudinal length. In one non-limiting embodiment, the first panel is formed of two or more sections that are adjustably connected together. In one non-limiting configuration, the first panel is formed of first and second panel sections that are connected so the first and second panels are slidably movable relative to one another so the longitudinal length of the first panel is adjustable. In another non-limiting configuration, one or both of the first and second panel sections include a) one or more side brackets, and b) one or more slot arrangements to enable the first and second panel sections to be slidably connected together. As can be appreciated, other adjustable connection arrangements can be used (e.g., snap arrangement, hook and loop fastener, magnet connection, nut and bolt arrangement, etc.). In one specific arrangement, one or both of the first and second panel sections include C-shaped side brackets to connect the first and second panel sections and enable the first and second panels to slidably move relative to one another. The one or more side brackets, and/or one or more slot arrangements can optionally be used to limit the extendable longitudinal length of the first panel; however, this is not required. The ability of the first panel to be adjustable in longitudinal length allows for the distance between the second and third panels to be adjusted. The adjustable connection between the first and second panel sections of the first panel allows for multiple adjustable spacings between the second and third panels when the second and third panels are in the open position.

In another and/or alternative non-limiting aspect of the present disclosure, the first and/or second panels of the first panel include position slots and/or ribs to enable the first and second panels to be moved to select positions relative to one another. The one or more slots/ribs can be configured to frictionally fix the first and second panel sections in position relative to one another, but also enable the first and second panel sections to be moved to other positions if a sufficient pushing or pulling force is applied to the ends of the first and/or second panel sections. The one or more slots/ribs can be located on a) one or both sides of the first and/or second panels, and/or b) a top and/or bottom surface of the first and/or second panel sections. The first and second panel sections can include one or more visual indicators (e.g., numbers, symbols, colored markings, etc.) to indicate a certain position of the first and second panel sections when moved relative to one another. In one non-limiting arrangement, the first and/or second panel sections include one or more numbers (e.g., 1, 2, 3, etc.) to provide visual position indicators when the first and/or second panel sections have moved to a certain position slot or rib on the first and/or second panel sections. In another non-limiting configuration, the second and/or third panels can include one or more visual indicators on a top and/or bottom side of the panel.

In another and/or alternative non-limiting aspect of the present disclosure, the pivot point and connection point on the first panel for the connection of the second panel to the first panel is spaced a first distance from a first end of the first panel, and the pivot point and connection point on the first panel for the connection of the third panel to the first panel is spaced a second distance from a second end of the first panel, and wherein the first distance and the second distance have a difference of 0-10% (and all values and ranges therebetween) from one another. In one non-limiting configuration, the first distance and the second distance are the same.

In another and/or alternative non-limiting aspect of the present disclosure, the second panel is connected to the top side of the first panel and the third panel is connected to the bottom side of the first panel. In one non-limiting embodiment, the second and third panels are pivotally connected to the first panel.

In another and/or alternative non-limiting aspect of the present disclosure, one or both ends of the first, second, and/or third panels has a curved profile. In one non-limiting arrangement, the curved profile is semi-circular shaped.

In another and/or alternative non-limiting aspect of the present disclosure, the second and/or third panel includes one or more mount openings to removably or temporarily secure the second and/or third panel to a ground surface. The size and/or location of the one or more mount openings on the second and/or third panels is non-limiting. In one non-limiting arrangement, the one or more mount openings are spaced from a side edge of the second and/or third panel and are optionally spaced from a center longitudinal axis of the second and/or third panel. The second and/or third panel can be configured to receive a stake or post that can be inserted through a mount opening and into a ground surface to thereby fixably secure the second and/or third panel in place relative to the ground surface. In one non-limiting arrangement, the second and third panels each include at least two mount openings that are located 0.1-2 inches mount opening from a side edge of the panel on which the mount openings are located, and the at least two mount openings are spaced 3-20 inches (and all values and ranges therebetween) from one another along a longitudinal axis of the panel on which the mount opening are located. The shape, length, size, and/or material of the stake or post is non-limiting.

In another and/or alternative non-limiting aspect of the present disclosure, the first, second and third panels are foldable with respect to one another such that the first, second, and third panels are oriented parallel to one another when in the folded position.

In another and/or alternative non-limiting aspect of the present disclosure, the first, second, and third panels can be oriented in an open position to form a generally C-shape or U-shape configuration; however, other configuration can be formed.

In another and/or alternative non-limiting aspect of the present disclosure, there is provided a plurality of swing guide legs that are configured to extend upwardly from the top surface of one or more of the panels. The swing guide legs are configured to assist a user in his/her golf swing. The size, shape, and length of the swing guide legs is non-limiting. The material used to form the body of the swing guide legs is generally a soft material to not damage or scratch a golf club when the golf club comes in contact with the swing guide leg. One non-limiting material that can be used for the swing guide legs is a foam material (e.g., low density PU foam, etc.) or a low durometer TPE. In another non-limiting embodiment, the swing guide legs have a longitudinal length of 2-20 inches (and all values and ranges therebetween). In another non-limiting embodiment, the swing guide legs have a square, rectangular, polygonal, oval, or circular cross-sectional shape along 50-100% of a longitudinal length (and all values and ranges therebetween) of the swing guide legs. The shape, size, and/or length of each of the body of the swing guide legs can be the same or different. In one non-limiting configuration, each of the swing guide legs has a body that has the same shape, size, and/or length and is formed of the same material. In another non-limiting configuration, the body of each of the swing guide legs has a generally cylindrical shape. In another non-limiting configuration, the body of each of the swing guide legs optionally has an internal cavity that extends 50-100% (and all values and ranges therebetween) the longitudinal length of the body.

In another and/or alternative non-limiting aspect of the present disclosure, there is provided a plurality of swing guide legs that are configured to extend upwardly from the top surface of one or more of the panels, and wherein one or more or all of the swing guide legs include a base portion that is configured to be detachably connectable to one or more of the panels. The detachable connection of the one or more swing guide legs can reduce or prevent damage to the golf club when the golf club contacts one or more of the swing guide legs. The material used to form the base portion of the swing guide legs is generally a different material from the material used to form the body; however, this is not required. The base portion includes a connection arrangement that is configured to easily connect and disconnect the base portion to one or more of the panels of the base body of the golf swing tool. The type of connection arrangement is non-limiting (e.g., magnet, hook and loop fastener, snap, slot connection, etc.). In one non-limiting arrangement, the detachable connection is a magnetic connection. In one non-limiting configuration, a) the base portion of each of the swing guide legs includes one or more magnets and the one or more panels include a strip, plate, region, etc., that is partially or fully formed of a ferromagnetic metal (e.g., iron, cobalt, steel, nickel, manganese, gadolinium, lodestone, etc.), b) the base portion of each of the swing guide legs includes one or more strips, plates, regions, etc., that are partially or fully formed of a ferromagnetic metal and the one or more panels include one or more magnets, or c) the base portion of each of the swing guide legs includes one or more magnets and the one or more panels include one or more magnets. In one specific arrangement, the base portion of each of the swing guide legs includes one or more magnets, and one or both of the second and third panels of the base body of the golf swing tool include two or more strips, plates, regions, etc., that are partially or fully formed of a ferromagnetic metals and wherein the two or more strips, plates, regions, etc., that are partially or fully formed of a ferromagnetic metal are spaced apart 2-20 inches (and all values and ranges therebetween) along the longitudinal axis of the panel. In another specific arrangement, the base portion of each of the swing guide legs includes one or more magnets, and the second and third panels of the base body of the golf swing tool include two or more strips, plates, regions, etc., that are partially or fully formed of a ferromagnetic metals and wherein the two or more strips, plates, regions, etc., that are partially or fully formed of a ferromagnetic metal are spaced apart 2-20 inches (and all values and ranges therebetween) along the longitudinal axis of the panel, and the other two panels of the base body of the golf swing tool include one strip, plate, region, etc., that is partially or fully formed of a ferromagnetic metal. In another specific arrangement, the one or more magnets can optionally include a rare earth magnet, a neodymium iron boron (NdFeB) magnet, a samarium cobalt (SmCo) magnet, an alnico magnet, a ceramic magnet, a ferrite magnet, etc.

In another and/or alternative non-limiting aspect of the present disclosure, one or more or all of the swing guide legs include a base portion that is configured to allow for multiple orientations of the longitudinal axis of the body of the swing guide leg relative to a top surface of a panel to which the swing guide leg is connected. As such, the base portion of the swing guide leg allows a user to orient the body of the swing guide leg at two or more different angles to customize the swing path of the golf club between the golf swing tool. The type of arrangement used to enable angular adjustment of the one or more swing guide legs is non-limiting (e.g., bendable wire arrangement, pivot rod arrangement, ball-and-socket joint, condyloid joint, hinged joints, etc.). In one non-limiting embodiment, the arrangement used to enable angular adjustment of the one or more swing guide legs is a hinged arrangement. In one non-limiting specific embodiment, the hinged arrangement is a ratchet-hinged arrangement. The base portion can optionally include two or more (e.g., 2-20 and all values and ranges therebetween) visual indicators to facilitate in providing information to a user as to the angle position of the base portion. In another non-limiting specific arrangement, the base portion includes a bottom portion that is configured to releasably connect to a panel of the base body of the golf swing tool, and a top portion that is connected to a bottom of the body of the swing guide leg, and wherein the bottom portion and the top portion are movable (e.g., pivot or rotate relative to one another above a pivot or rotational axis, etc.) relative to one another.

In another and/or alternative non-limiting aspect of the present disclosure, the bottom on one or more of the panels of the base body of the golf swing tool can optionally include a gripping surface (e.g., gripping pad, roughed bottom surface, bottom surface with one or more spikes, etc.). In one non-limiting embodiment, the second and/or third panels include a gripping surface on the bottom surface of the panels. In another non-limiting embodiment, the gripping surface is optionally a gripping pad (e.g., rubber pad, foam pad, etc.) that overlies 20-100% (and all values and ranges, therebetween) of the bottom surface of the panel. The gripping pad (when used) can be connected to the bottom surface of the panel by different arrangements (e.g., adhesive, staple, nail, screw, clip, melted connection, etc.). In another non-limiting embodiment, the shape and/or thickness of the gripping pad on the second and third panels is the same; however, this is not required. In another non-limiting embodiment, the thickness (e.g., 0.0-1 inches and all values and ranges therebetween) of the gripping pad (when used) is typically less than the thickness of the panel; however, this is not required.

These and other objects and advantages will become apparent from the discussion of the distinction between the disclosure and the prior art and when considering the non-limiting embodiment illustrated in the accompanying drawings.

BRIEF DESCRIPTION OF THE DRAWINGS

Non-limiting and non-exhaustive embodiments are described with reference to the following drawings, wherein like labels refer to like parts throughout the various views unless otherwise specified. The sizes and relative positions of elements in the drawings are not necessarily drawn to scale. For example, the shapes of various elements are selected, enlarged, and positioned to improve drawing legibility. The particular shapes of the elements as drawn have been selected for ease of recognition in the drawings. Reference may now be made to the drawings, which illustrate various embodiments that the disclosure may take in physical form and in certain parts and arrangement of parts wherein.

DETAILED DESCRIPTION OF NON-LIMITED EMBODIMENTS

Figure 1:
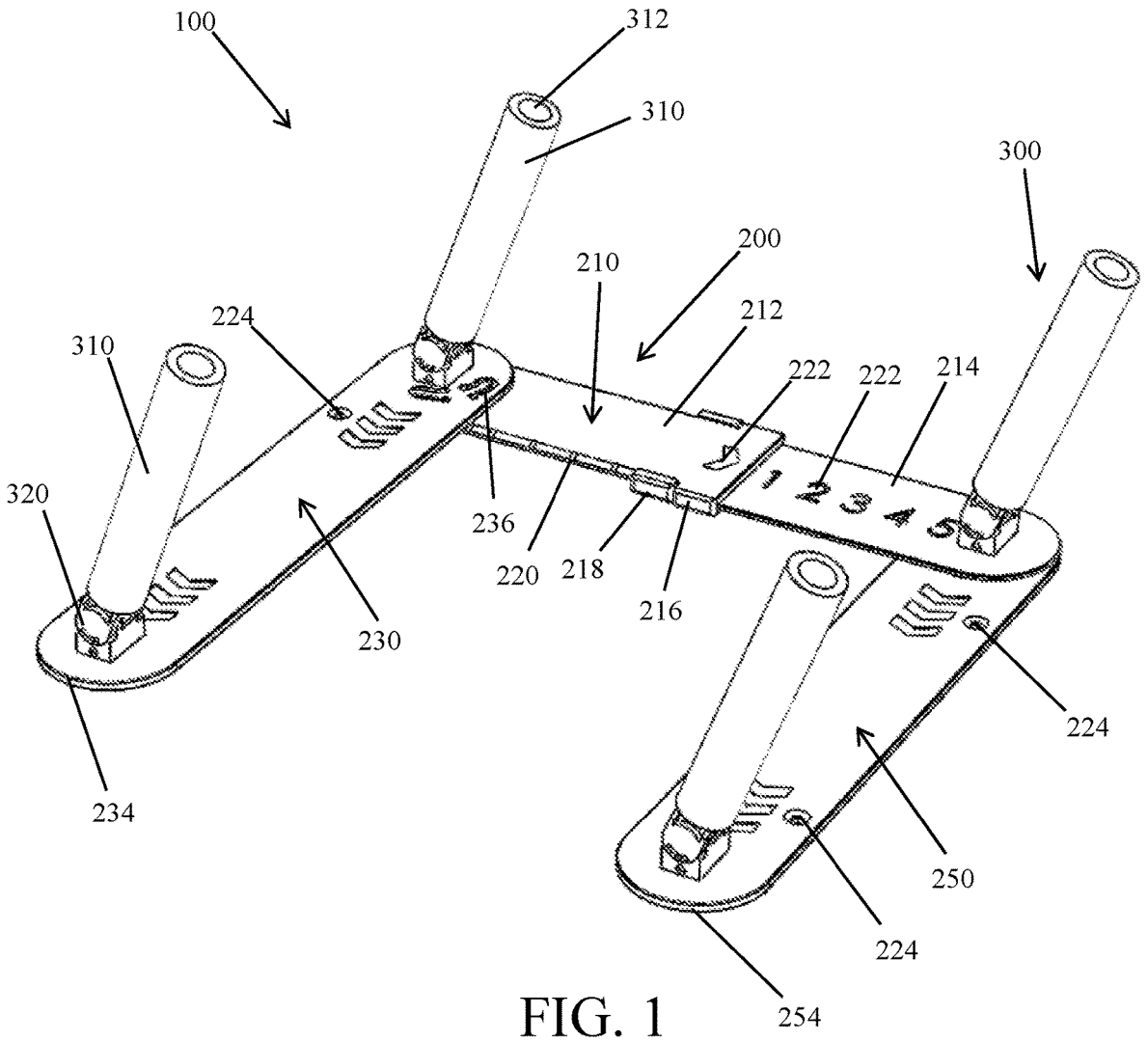
FIG. 1 is a front isometric view of the golf swing tool in the fully open position.

A more complete understanding of the articles/devices, processes and components disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of" The terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any unavoidable impurities that might result therefrom, and excludes other ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 inches to 10 inches" is inclusive of the endpoints, 2 inches and 10 inches, and all the intermediate values).

The terms "about" and "approximately" can be used to include any numerical value that can vary without changing the basic function of that value. When used with a range, "about" and "approximately" also disclose the range defined by the absolute values of the two endpoints, e g. "about 2 to about 4" also discloses the range "from 2 to 4." Generally, the terms "about" and "approximately" may refer to plus or minus 10% of the indicated number.

Various non-limiting embodiments of the present disclosure will now be described to provide an overall understanding of the principles of the structure, function, and use of the apparatus, systems and methods disclosed. Those of ordinary skill in the art will understand that apparatus, systems and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure. Any failure to specifically describe a combination or sub-combination of components should not be understood as an indication that any combination or sub-combination is not possible.

It will be appreciated that modifications to disclosed and described examples, arrangements, configurations, components, elements, apparatuses, devices, systems, methods, etc. can be made and may be desired for a specific application. Also, for any methods described, regardless of whether the method is described in conjunction with a flow diagram, it should be understood that unless otherwise specified or required by context, any explicit or implicit ordering of steps performed in the execution of a method does not imply that those steps must be performed in the order presented but instead may be performed in a different order or in parallel.

Referring now to FIGS. 1-9, there is illustrated a golf swing tool 100. Golf swing tool 100 include a base body 200 and a plurality of swing guide legs 300.

Base body 200 is formed of three longitudinal panels, namely a first panel 210, a second panel 230, and a third panel 250. Second and third panels 230, 250 are each connected to first panel 210 and second and third panels 230, 250 are spaced from one another when in the open position as illustrated in FIGS. 1-5. Second and third panels 230, 250 are illustrated as being formed of a single piece of material and having the same shape and size. Second and third panels 230, 250 are illustrated as having a rectangular shape and constant thickness along 65-90% of the longitudinal length of the panels. Each of ends 232, 234 of second panel 230 and each of ends 252, 254 of third panel 250 is illustrated as being arcuate (e.g., semi-circular, etc.). The material used to form panels 210, 230, 250 is non-limiting (e.g., plastic, wood, metal, fiberglass, glass, ceramic, composite material, etc.). In one non-limiting configuration, the longitudinal length of panels 230, 250 is 12-25 inches (and all values and ranges therebetween), the maximum width of panels 210, 230, 250 is 2-6 inches (and all values and ranges therebetween), and the thickness of panels 230, 250 is 0.1-1 inch (and all values and ranges therebetween).

Figure 2:
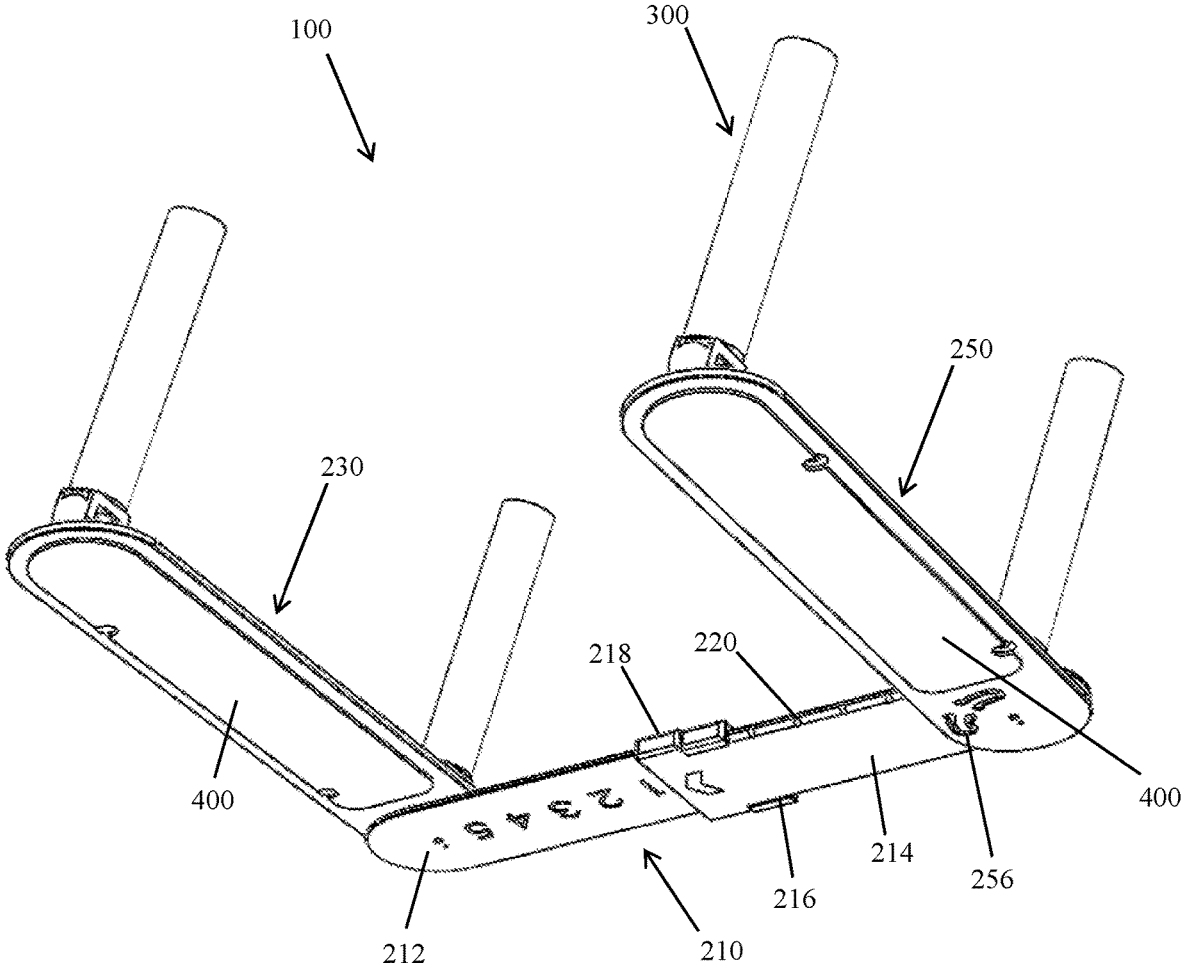
FIG. 2 is a bottom isometric view of the golf swing tool of FIG. 1.
Figure 3:
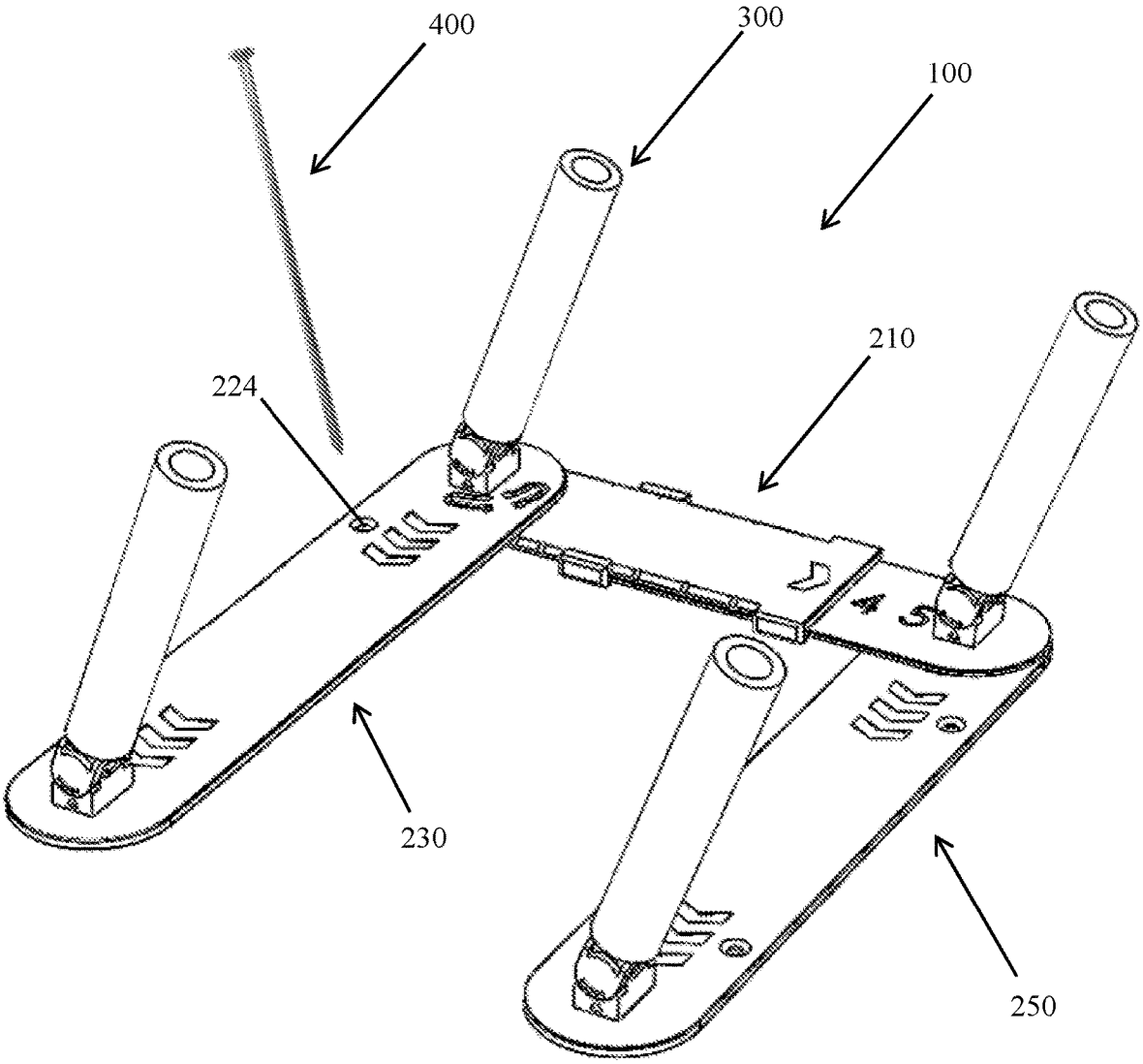
FIG. 3 is a front isometric view of the golf swing tool in the partially narrowed orientation.
Figure 4:
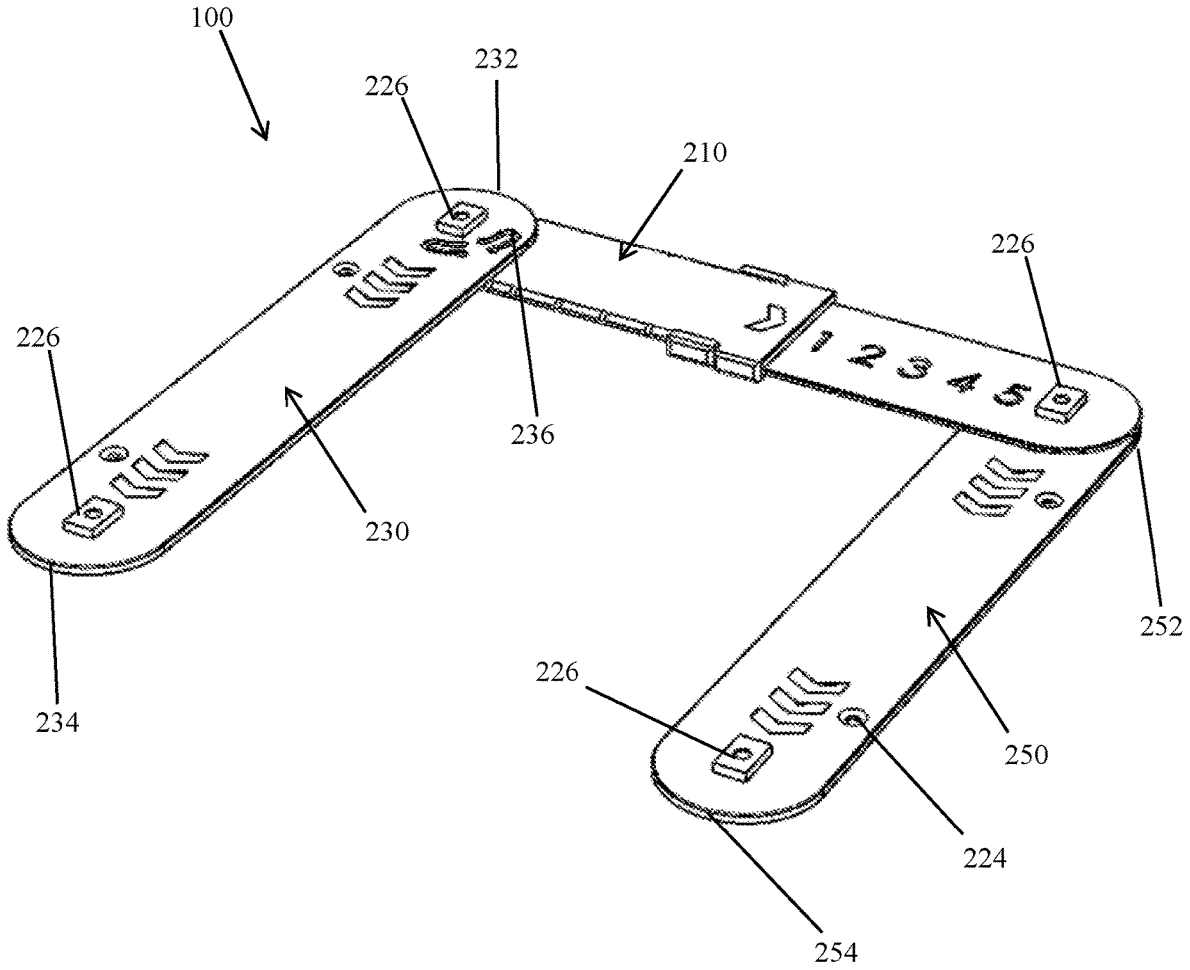
FIG. 4 is a front isometric view of the golf swing tool of FIG. 1 that is absent the swing guide legs.
Figure 8:
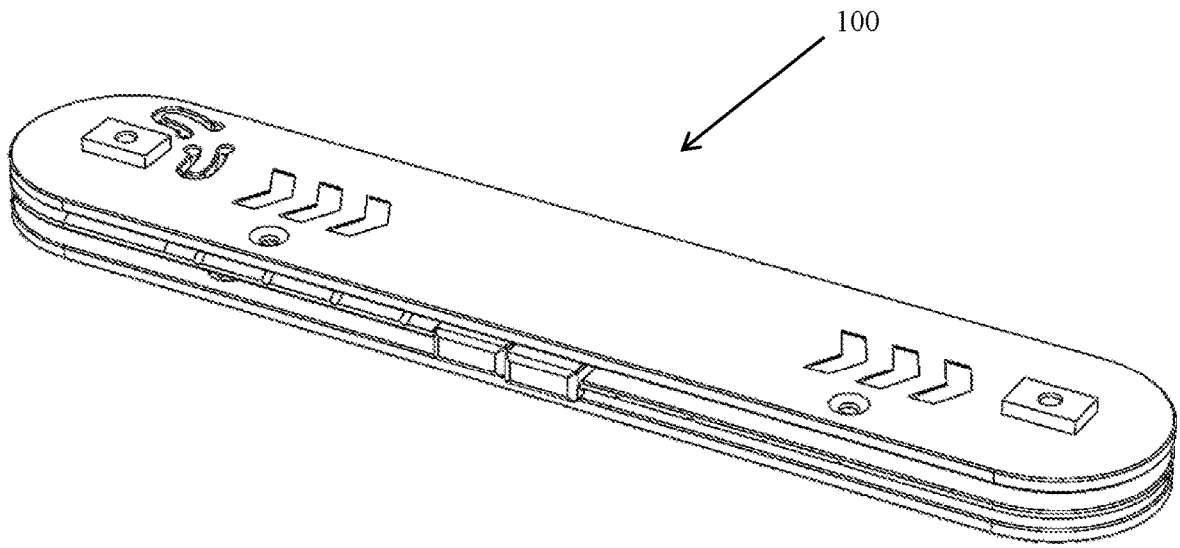
FIG. 8 is a front isometric view of the golf swing tool of FIG. 1 in the fully collapsed and dissembled position.
Figure 9:
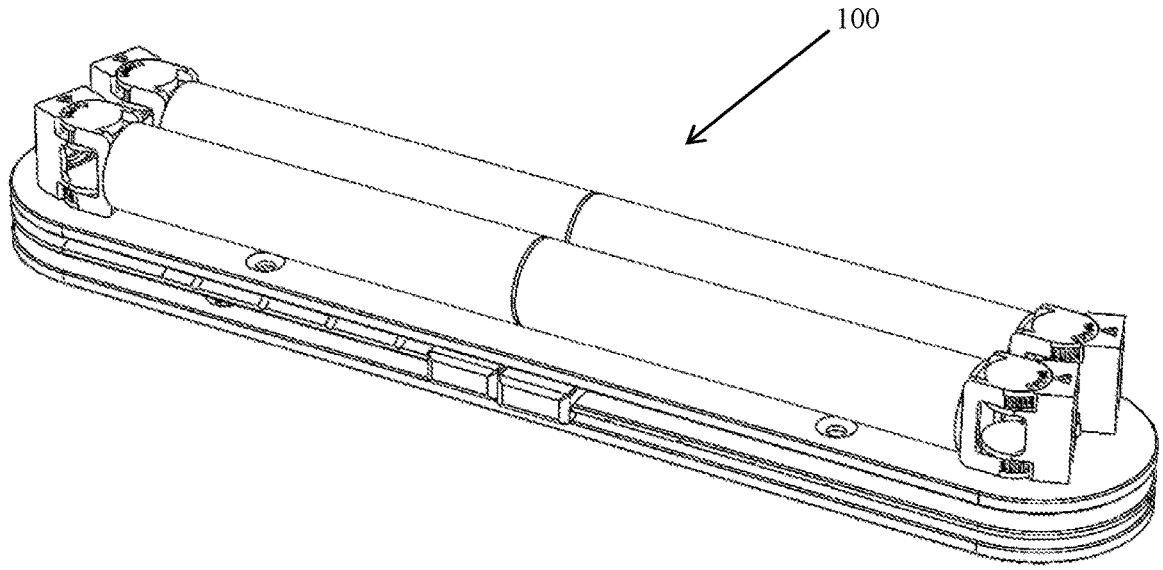
FIG. 9 is a front isometric view of the golf swing tool of FIG. 4 in the fully collapsed position.

Second and third panels 230, 250 are illustrated as pivotally connected to first panel 210. The type of pivot connection is non-limiting. In one non-limiting arrangement, second and third panels 230, 250 can rotate 0-135° (and all values and ranges therebetween) about a pivot or connection point between the second patent and the first panel and/or the third panel and the first panel. The pivot connection can optionally include one or more pivot guides 236, 256 on one or more of the panels so as to limit the amount of rotation of the second and/or third panels relative to the first panel. As illustrated in FIGS. 2 and 4, both second and third panels 230, 250 each include two pivot guides 236, 256 used to limit the amount of rotation of the second and/or third panels relative to the first panel. The pivot guides on the one or more panels can also be used to limit the direction of rotation of the second and/or third panels relative to the first panel when rotating second and third panels 230, 250 between the open and closed positions. As illustrated in FIGS. 8 and 9, second and third panels 230, 250 are positioned in the closed or collapsed position. As illustrated in FIGS. 1-5, second and third panels 230, 250 are positioned in the open position. In one non-limiting embodiment, second panel 230 is connected to first panel 210 such that second panel 230 can only be rotated clockwise when the second panel is moved from the closed to the open position. In another non-limiting embodiment, third panel 250 is connected to the first panel 210 such that third panel 250 can only be rotated counter clockwise when the third panel is moved from the closed to the open position. The one or more pivot guides on the second and/or third panels limit the direction of rotation of the second and/or third panels when being rotated relative to the first panel.

Referring now to FIGS. 1-5, first panel 210 can be configured such that the longitudinal length of the first panel can be adjusted. First panel 210 is illustrated as including first and second panel sections 212, 214 that are adjustably connected together. In one non-limiting embodiment, the length and/or shape of first and second panel sections 212, 214 is the same; however, this is not required. In one non-limiting embodiment, the thickness and width of the first and second panel sections 212, 214 is the same; however, this is not required. In another non-limiting embodiment, the maximum extendable longitudinal length of first panel 210 is the same or within 10% (e.g., 0-10% and all values and ranges therebetween) of the longitudinal length of second and third panels 230, 250; however, this is not required. In another non-limiting embodiment, the thickness of first and second panel sections 212, 214 is the same as the thickness of second and third panels 230, 250; however, this is not required.

First panel section 212 is pivotally connected to second panel 230 and second panel section 214 is pivotally connected to third panel 250. As illustrated in FIGS. 1-5, second panel 230 is pivotally connected to the top surface of first panel section 212, and third panel 250 is pivotally connected to the bottom surface of second panel section 214. As also illustrated in FIGS. 1-5, second panel 230 is pivotally connected to the top surface of first panel section 212 near (e.g., within 0.1-4 inches and all values and ranges therebetween) to the curved end of first panel section 212, and third panel 250 is pivotally connected to the bottom surface of second panel section 214 near (e.g., within 0.1-4 inches and all values and ranges therebetween) to the curved end of second panel section 214.

First and second panel sections 212, 214 are illustrated as being slidably movable relative to one another so that the longitudinal length of the first panel is adjustable. In one non-limiting embodiment, one or both of first and second panel sections 212, 214 include one or more side brackets 216, 218 that are configured to enable first and second panel sections 212, 214 to be slidably connected together. Side brackets 216, 218 can optionally be configured to limit the extendable longitudinal length of first panel 210; however, this is not required. Side bracket 216 is formed on or permanently connected to first panel section 212, and side bracket 218 is formed on or permanently connected to second panel section 214. A portion of side bracket 216 is configured to overlie a portion of one or both the side edges and also the bottom side of second panel section 214 when the first and second panel sections are connected together. A portion of side bracket 218 is configured to overlie a portion of one or both the side edges and also the top side of first panel section 212 when the first and second panel sections are connected together. The longitudinal length of side brackets 216, 218 can optionally be the same (e.g., 1-60% and all values and ranges therebetween of the longitudinal length of the first or second panel section). The shape and configuration (e.g., C-shaped or U-shaped configuration, etc.) of side brackets 216, 218 can optionally be the same. As illustrated in FIGS. 1-5, the ability of the first panel to be adjustable in longitudinal length allows for the distance between the second and third panels to be adjusted when the second and third panels are in the open position.

First panel section 212 is illustrated as including a plurality of slots or ribs 220 to enable the first and second panel sections to be move to select positions relative to one another. The one or more slots/ribs can be configured to frictionally fix the first and second panel sections in position relative to one another, but also enable the first and second panel sections to be moved to other positions if a sufficient pushing or pulling force is applied to the ends of the first and/or second panel sections. Slots/ribs 220 are located on one or both sides of first panel section 212. First and second panel sections 212, 214 can include one or more visual indicators 222 (e.g., numbers, symbols, colored markings, etc.) to indict a certain position of the first and second panel sections when moved relative to one another. In one non-limiting arrangement, first panel section 212 includes a visual marking 222 in the form of arrows and second panel section 214 includes a visual marking 222 in the form of numbers (e.g., 1, 2, 3, 4, 5, etc.) to provide a visual position indicator when the first and/or second panel sections have moved to a certain position slot or rib on the first and/or second panel sections. Position 1 is illustrated as indicating the position of first panel 210 in the longest longitudinal length position and Position 5 is illustrated as indicating the position of first panel 210 in the shortest longitudinal length position. As illustrated in FIGS. 1-5, visual markings 222 are located on both sides of the first and second panel sections; however, this is not required.

Referring again to FIGS. 1-5, second and third panels 230, 250 can optionally include one or more mount openings 224 that are used with a stake or post 400 to temporarily secure the second and/or third panel to a ground surface. The size and/or location of one or more mount openings 224 on the second and/or third panels is non-limiting. As illustrated in FIGS. 1-5, two mount openings 224 on each of second and third panels 230, 250 are spaced from a side edge of the second and third panels. When the body of stakes or posts 400 are inserted through one or more mount openings 224 and into the ground, second and/or third panels 230, 250 are secured in position relative to the ground. When stakes or posts 400 are removed from one or more mount openings 224, the second and/or third panels are again movable relative to the ground surface or be removed from the ground surface.

Referring now to FIGS. 1-5, 8 and 9, first, second, and third panels 210, 230, 250 are foldable with respect to one another such that the first, second, and third panels are oriented parallel to one another when in the folded or closed position as illustrated in FIGS. 8 and 9, the second and third panels can be oriented in an open position to form a generally C-shaped or U-shaped configuration as illustrated in FIGS. 1-5. When the first, second, and third panels are oriented parallel to one another when in the folded or closed position as illustrated in FIGS. 8 and 9, the golf swing tool 100 is in a compact storage position.

Referring again to FIGS. 1-3, 6, 7 and 9, one or more swing guide legs 300 are configured to be connected to the top surface of one or more of panels 210, 230, 250. Swing guide legs 300 are configured to extend upwardly from the top surface of one or more of the panels. One or more swing guide legs 300 are configured to assist a user in his/her golf swing. The size, shape, and length of the swing guide legs are non-limiting. The material used to form body 310 of swing guide legs 300 is generally a soft material so as to not damage or scratch a golf club when the golf club comes in contact with the swing guide leg. One non-limiting material that can be used for the swing guide legs is a foam material (e.g., low density PU foam, etc.) or a low durometer TPE.

Swing guide legs 300 have a longitudinal length of 2-20 inches (and all values and ranges therebetween). As illustrated in the FIGS. 1-3, 6, 7 and 9, body 310 of swing guide legs 300 has a generally cylindrical shape; however, other shapes can be used. Body 310 of one or more of swing guide legs optionally has an internal cavity 312 that extends 50-100% (and all values and ranges therebetween) the longitudinal length of the body.

Swing guide legs 300 include a base portion 320 that is configured to be detachably connectable to one or more of the panels. The detachable connection of the one or more swing guide legs can reduce or prevent damage to the golf club when the golf club contacts one or more of the swing guide legs. The material used to form the base portion of the swing guide legs is generally a different material from the material used to form the body; however, this is not required.

Figure 5:
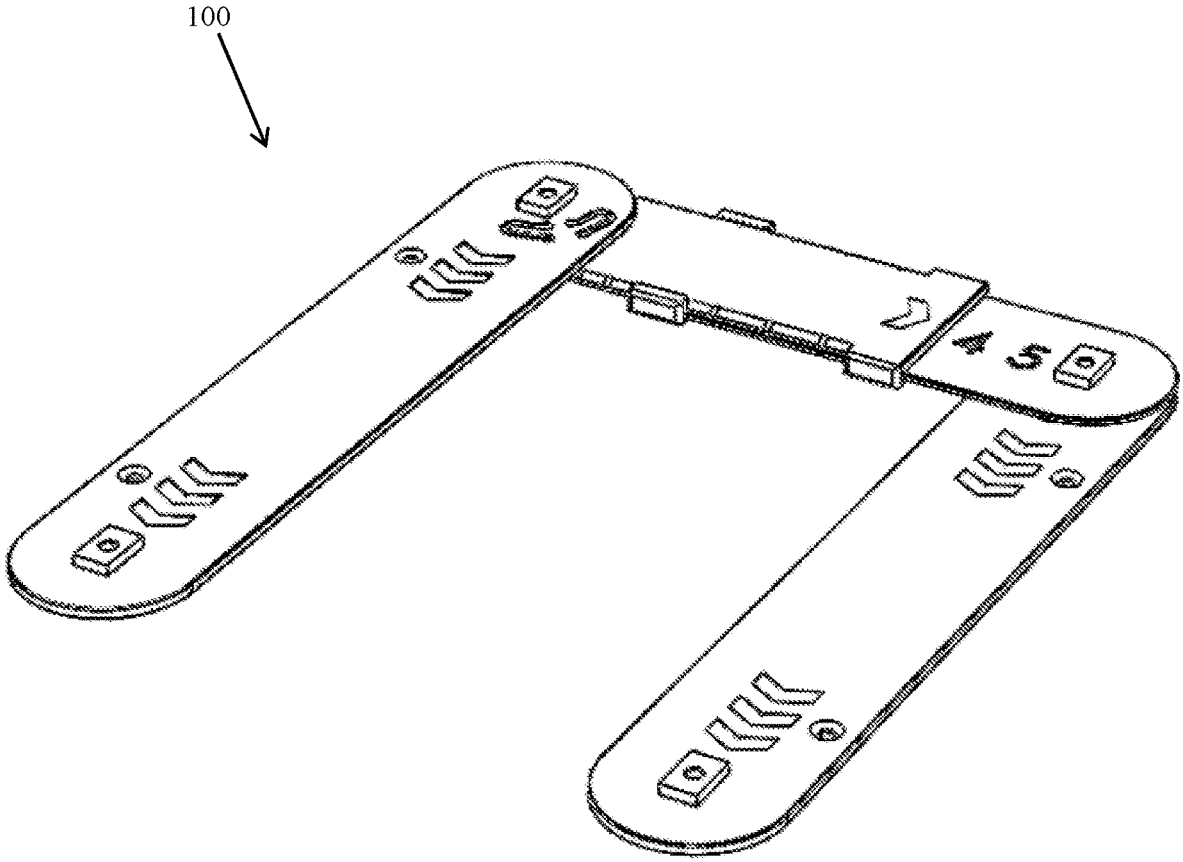
FIG. 5 is a front isometric view of the golf swing tool of FIG. 3 that is absent the swing guide legs.

The base portion S includes a connection arrangement that is configured to easily connect and disconnect the base portion S to one or more of the panels of the base body of the golf swing tool. The type of connection arrangement is non-limiting (e.g., magnet, hook and loop fastener, snap, slot connection, etc.). In one non-limiting arrangement, the detachable connection is a magnetic connection. As illustrated in FIGS. 4 and 5, the top surface of one or more of panels 210, 230, 250 includes a connection structure 226 in the form of a magnet or ferromagnetic metals (e.g., iron, cobalt, steel, nickel, manganese, gadolinium, lodestone, etc.). FIGS. 4 and 5 illustrate that the second panel includes two connection structures 226 and the first and third panels include a single connection structure 226. As can be appreciated, other arrangements of the connection structures on the one or more panels can be used.

Figure 7:
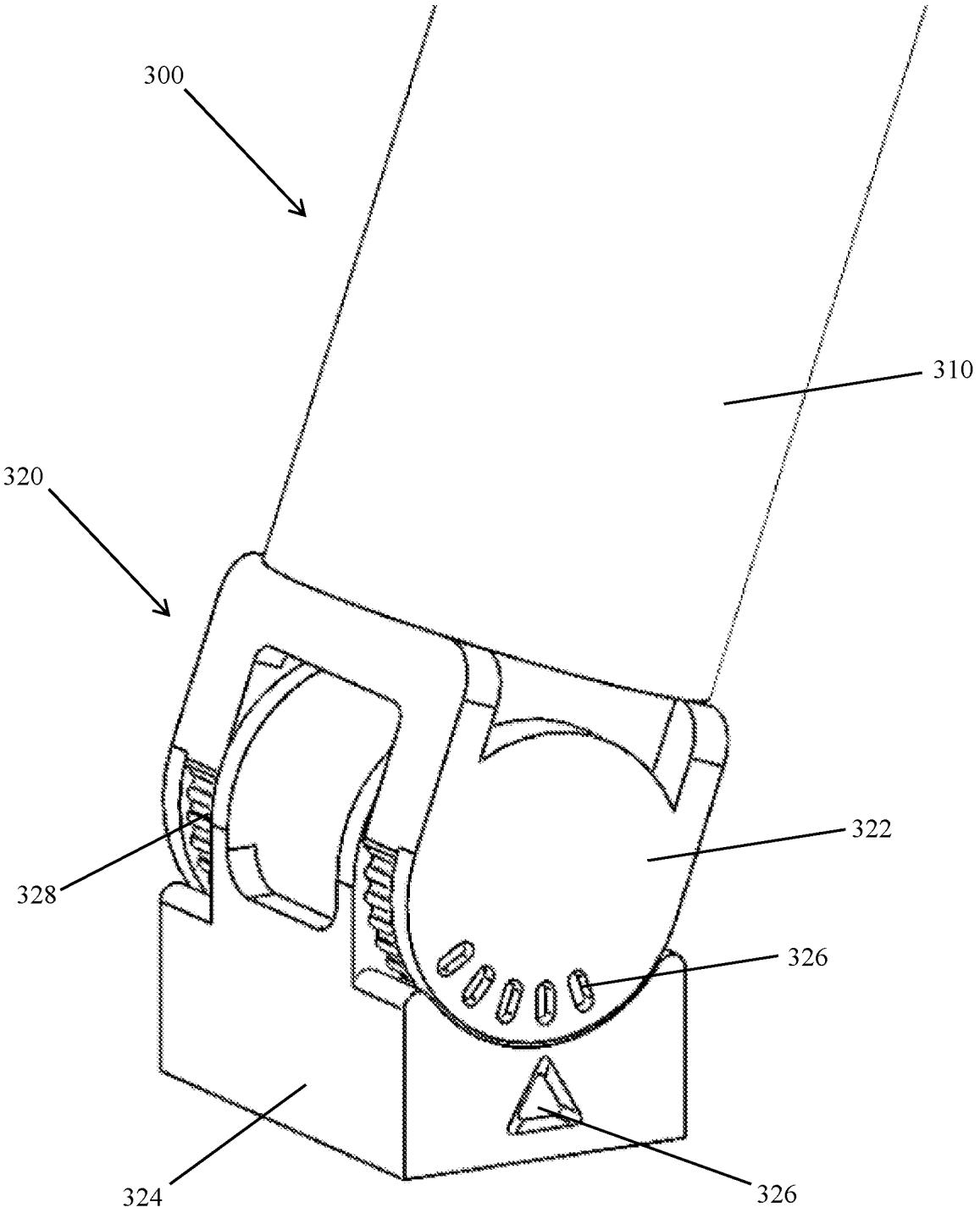
FIG. 7 is an enlarged bottom portion of the swing guide leg of FIG. 6.
Figure 7A:
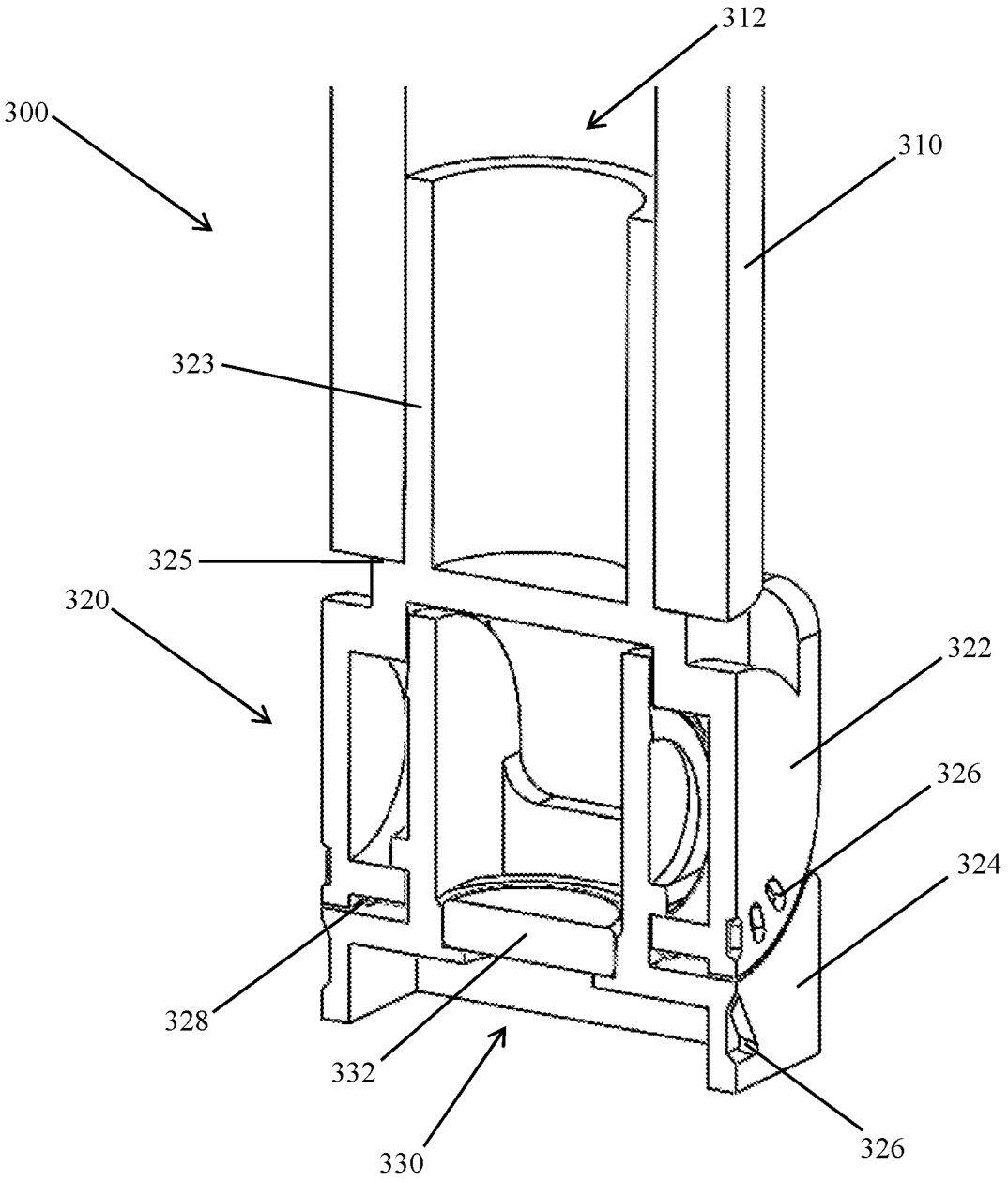
FIG. 7A is a cross-sectional view of the bottom portion of the swing guide leg of FIG. 6.

As illustrated in FIG. 7A, the bottom of base portion 320 optionally includes a cavity 330 that partially or fully telescopically receives a portion of all of the height of the connection structure to which the base portions is detachably connected. In one non-limiting embodiment, the interior of cavity 330 includes a magnet 332 that detachably connects to a connections structure 226. The cross-sectional shape of cavity 330 can be the same as the outer perimeter of connection structure 226; however, this is not required. Generally, the height of the connection structure is 0.1-1.5 inches (and all values and ranges therebetween). As illustrated in FIG. 7A, magnet 332 can optionally be spaced above cavity 330 such that the magnet does not directly contact connection structure 226 when base portion 320 is removably connected to the panel.

Figure 6:
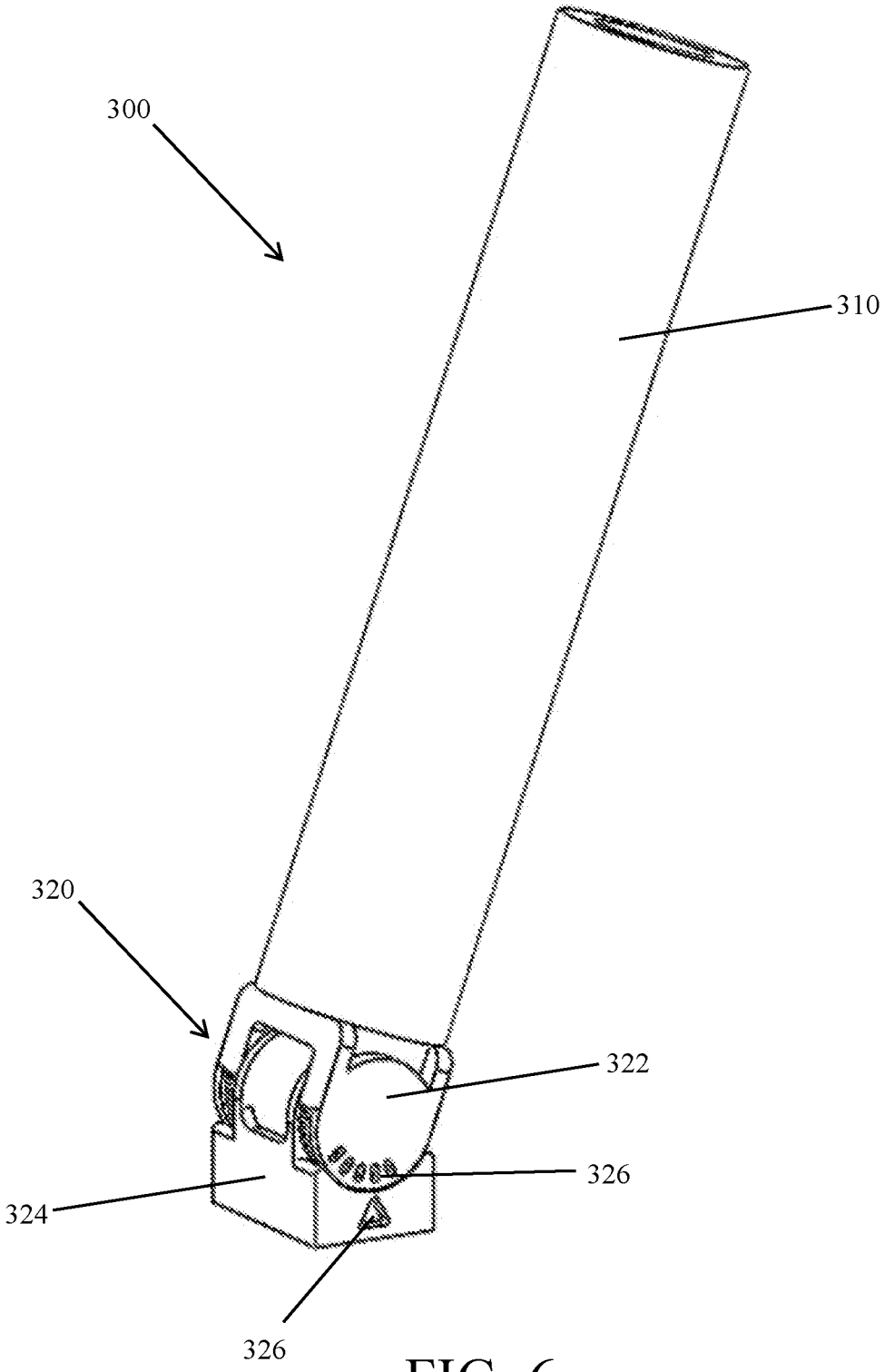
FIG. 6 is a front isometric view of a swing guide leg.

Referring now to FIGS. 6, 7 and 7A, base portion 320 is configured to allow for multiple orientations of the longitudinal axis of body 310 of swing guide leg 300 relative to a top surface of a panel 210, 230, 250 to which swing guide leg 300 is connected. As such, base portion 320 of swing guide leg 300 allows a user to orient body 310 of swing guide leg 300 to two or more different angles to customize the swing path of the golf club between golf swing tool 100. During use of golf swing tool 100, a user places a golf ball between the second or third panels and forwardly of the first panel. The optional arrows on the top surface of the send and third panels indicates to the user the direction that golf ball is to be hit. Generally, the golf ball is placed an equal distance from the inner edge of the second and third panels; however, this is not required. The longitudinal length of the first panel can be adjusted by the user as desired. Posts or stakes 400 can optionally be used to secure the second and third panels in position during use of golf swing tool 100. The number swing guide legs 300 positioned on the first, second, and/or third panels and the angle of swing guide legs 300 can be selected by the user as desired. During use of golf swing tool 100, if one or more of swing guide legs 300 is knocked off first, second, and/or third panels, the knocked off swing guide leg 300 can be simply reattached to the first, second, and/or third panels. During use of golf swing tool 100, a user can a) adjust the longitudinal length of the first panel, b) select the number of swing guide legs 300 that are to be attached to first, second, and/or third panels, c) select the location on which one or more swing guide legs 300 are to be attached to the first, second, and/or third panels, c) select the angle of one or more swing guide legs 300, d) temporarily secure the second and/or third panels to a ground surface by use of one or more post or stakes, and/or e) position the golf ball at different locations between the inner edges of the second and third panels and forwardly of the front edge of the first panel. After use of golf swing tool 100, golf swing tool 100 can be disassembled and oriented for storage and/or transport as illustrated in FIGS. 8 and 9.

As best illustrated in FIGS. 6 and 7, base portion 320 includes an upper portion 322 and a lower portion 324 that are pivotally connected together by a hinged arrangement. The upper portion is connected to body 310 of swing guide leg 300 and lower portion 324 is removably connectable to connection structure 226 on one or more panels 210, 230, 250. The hinged arrangement can optionally be a ratchet-hinged arrangement that includes a plurality of ratchet grooves or slots 328. Base portion 320 can optionally include two or more visual indicators 326 to facilitate in providing information to a user as to the angle position of the base portion. As illustrated in FIG. 7, the visual indicators are located both on upper and lower portions 322, 324; however, this is not required. As can be appreciated, one or more of swing guide legs 300 can be oriented to extend perpendicular to the top surface of a panel, or be angled at one or more angles toward the second or third panel or angled away from the second or third panel. The orientation of two or more of the swing guide legs can be the same or different.

Referring again to FIG. 7A, upper portion 322 of base portion 320 can optionally include a body flange 323 that is configured to be inserted into cavity 312 of body 310 of swing guide leg 300 so as to secure body 310 to base portion 320. The connection between body 310 and the base portion can be by a friction fit and/or by other arrangements (e.g., adhesive, melted connection, clamp, etc.). Upper portion 332 can optionally include a stop landing 325 to limit the distance the body can be inserted about body flange 323.

The bottom surface of one or more of the panels of the base body of the golf swing tool can optionally include a gripping surface (e.g., gripping pad, roughed bottom surface, bottom surface with one or more spikes, etc.). As illustrated in FIG. 2, the bottom surface of second and third panel 230, 250 include a gripping surface 400. Gripping surface 400 is optionally a gripping pad (e.g., rubber pad, foam pad, etc.) that overlies 20-100% (and all values and ranges, therebetween) of the bottom surface of the panel. The gripping pad (when used), can be connected to the bottom surface of the panel by different arrangements (e.g., adhesive, staple, nail, screw, clip, melted connection, etc.).

Reference throughout the specification to "various embodiments," "some embodiments," "one embodiment," "some example embodiments," "one example embodiment," or "an embodiment" means that a particular feature, structure, or characteristic described in connection with any embodiment is included in at least one embodiment. Thus, appearances of the phrases "in various embodiments," "in some embodiments," "in one embodiment," "some example embodiments," "one example embodiment, or "in an embodiment" in places throughout the specification are not necessarily all referring to the same embodiment. Furthermore, the particular features, structures or characteristics may be combined in any suitable manner in one or more embodiments.

To aid the Patent Office and any readers of this application and any resulting patent in interpreting the claims appended hereto, Applicant does not intend any of the appended claims or claim elements to invoke 35 U.S.C. 112(f) unless the words "means for" or "step for" are explicitly used in the particular claim.

It will thus be seen that the objects set forth above, among those made apparent from the preceding description, are efficiently attained, and since certain changes may be made in the constructions set forth without departing from the spirit and scope of the disclosure, it is intended that all matter contained in the above description and shown in the accompanying drawings shall be interpreted as illustrative and not in a limiting sense. The disclosure has been described with reference to preferred and alternate embodiments. Modifications and alterations will become apparent to those skilled in the art upon reading and understanding the detailed discussion of the disclosure provided herein. This disclosure is intended to include all such modifications and alterations insofar as they come within the scope of the present disclosure. It is also to be understood that the following claims are intended to cover all of the generic and specific features of the disclosure herein described and all statements of the scope of the disclosure, which, as a matter of language, might be said to fall there between. The disclosure has been described with reference to the certain embodiments. These and other modifications of the disclosure will be obvious from the disclosure herein, whereby the foregoing descriptive matter is to be interpreted merely as illustrative of the disclosure and not as a limitation. It is intended to include all such modifications and alterations insofar as they come within the scope of the appended claims.

What is claimed is:

1. A golf swing tool used to improve a golf swing of a user, said golf swing tool comprising:

a base body; and a swing guide leg;

said base body includes first, second, and third panels;

said second panel rotatably connected to said first panel;

said third panel rotatably connected to said first panel;

said second and third panels are not connected together;

said swing guide leg including a base portion and a body; and said base portion of said swing guide leg detachably connectable to a top surface of one of said first, second, and third panels such that when said base body is positioned on a ground surface during use of said golf swing tool said body of said quide leg extends upwardly from said top surface of one of said first, second, and third panels; and wherein said first panel is configured to enable said second and third panels to be rotated relative to said first panel such that said second and third panels are spaced from one another during use of said golf swing tool wherein the user can position a golf ball between said second and third panels during use of said golf swing tool; and wherein said base portion of said swing guide leg is configured to detach from said top surface of one of said first, second, and third panels when a golf club contacts said body of said swing guide leg to thereby reduce or prevent damage to the golf club.

2. The golf swing tool as defined in claim 1, wherein said second and third panels are pivotally connected to said first panel such that said second and third panels can rotate no more than 270° relative to said first panel.

3. The golf swing tool as defined in claim 1, wherein said second and third panels are each connected to said first panel such that said second panel can only rotate clockwise relative to said first panel when said second panel is moved to an open position, and said third panel can only rotate counter-clockwise relative to said first panel when said third panel is moved to an open position.

4. The golf swing tool as defined in claim 1, wherein said first panel is configured to be adjustable in longitudinal length.

5. The golf swing tool as defined in claim 4, wherein:

said first panel includes first and second panel sections that are slidably connected together;

said second panel is rotatably connected to said first panel section; and said third panel is rotatably connected to said second panel section.

6. The golf swing tool as defined in claim 5, wherein said first and/or second panel sections include one or more side brackets configured to slidably connect together said first and second panel sections.

7. The golf swing tool as defined in claim 5, wherein said first and/or second panel sections include a position arrangement; said position arrangement includes one or more slots and/or ribs; said position arrangement configured to facilitate in frictionally maintaining said first and second panel sections in position relative to one another until a sufficient pushing or pulling force is applied to an end of said first and/or second panel sections.

8. The golf swing tool as defined in claim 5, wherein said first and/or second panel sections include a visual position indicator; said visual position indicator including one or more numbers, symbols, and/or colored markings; said visual position indicator positioned on a top and/or bottom surface of said first and/or second panel sections.

9. The golf swing tool as defined in claim 1, wherein said second and/or third panels include one or more mount openings; each of said mount openings is configured to receive a body of a post and/or stake to temporarily secure said second and/or third panels to a ground surface.

10. The golf swing tool as defined in claim 1, wherein: swing guide leg includes a body and a base portion;

said body of said swing guide leg is formed of a different material from said base portion of said swing quide leg;

a bottom portion of said body of said swing guide leg is connected to a top portion of said base portion of said swing guide leg; and said body of said swing guide leg is formed of a compressible and flexible material.

11. The golf swing tool as defined in claim 1, wherein said swing guide leg is detachably connected to one of said first, second, or third panels by a magnetic connection.

12. The golf swing tool as defined in claim 11, wherein said first, second and/or third panels includes one or more connection structures; each of said connection structures is configured to facilitate in formation of said magnetic connection between said swing guide leg and one of said first, second, or third panels.

13. The golf swing tool as defined in claim 11, wherein said swing guide leg includes a magnet.

14. The golf swing tool as defined in claim 1, wherein a gripping pad is connected to a bottom surface of said second and/or third panels; said gripping pad formed from a different material than a material use to form said second and/or third panels.

15. The golf swing tool as defined in claim 14, wherein said gripping pad includes a rubber pad and/or a foam pad.

16. The golf swing tool as defined in claim 1, wherein said swing guide leg is detachably connected to said top surface of one of said first, second, or third panels by a hook and loop fastener connection.

17. The golf swing tool as defined in claim 1, wherein said swing guide leg is detachably connected to said top surface one of said first, second, or third panels by a snap or slot connection.

18. A golf swing tool used to improve a golf swing of a user, said golf swing tool comprising:

a base body including first, second, and third panels; and a swing guide leg having a base portion that is detachably connectable to one of first, second, and third panels;

wherein said second panel is rotatably connected to a top side of said first panel and said third panel is rotatably connected to a bottom side of said second panel to thereby enable said first, second, and third panels to be rotated between open and closed positions;

wherein when said first, second, and third panels are in their closed positions said first panel is below said second panel and above said third panel and thereby sandwiched between said second and third panels;

wherein when said first, second and third panels are in their open positions said first, second, and third panels form a generally C-shaped or U-shaped configuration with said second and third panels generally parallel to one another and generally perpendicular to said first panel;

wherein the user can position a golf ball between said second and third panels during use of said golf swing tool when said first, second and third panels are in their open positions; and wherein said base portion of said swing guide leg is configured to detach from a top surface of one of said first, second, and third panels when a golf club contacts said swing guide leg to thereby reduce or prevent damage to the golf club.

19. A golf swing tool used to improve a golf swing of a user, said golf swing tool comprising:

a base body; and a swing guide leg including a base portion and a body;

said base portion of said swing guide leg detachably connectable to a top surface of the base body;

wherein said base portion of said swing guide leg includes an upper portion and a lower portion that are pivotally connected together by a hinged arrangement to enable multiple orientations of a longitudinal axis of said body of said swing guide leg relative to the top surface one of said base body when said swing guide leg is detachably connected to the top surface of the base body.

20. The golf swing tool as defined in claim 19, wherein said base portion of said swing guide leg includes one or more visual indicators to facilitate in providing information to a user as to an angle position of said base portion of said swing guide leg.

21. The golf swing tool as defined in claim 19, wherein said swing guide leg is detachably connected to said top surface of said base body by a magnetic connection.

22. The golf swing tool as defined in claim 19, wherein said swing guide leg is detachably connected to said top surface of said base body by a hook and loop fastener connection.

23. The golf swing tool as defined in claim 19, wherein said swing guide leg is detachably connected to said top surface of said base body by a snap or slot connection.

* * * * *